US010968688B1

(12) United States Patent
Bedford

(10) Patent No.: US 10,968,688 B1
(45) Date of Patent: Apr. 6, 2021

(54) WINDOW SECURITY ASSEMBLY

(71) Applicant: Weldon Bedford, Austell, GA (US)

(72) Inventor: Weldon Bedford, Austell, GA (US)

( * ) Notice: Subject to any disclaimer, the term of this patent is extended or adjusted under 35 U.S.C. 154(b) by 0 days.

(21) Appl. No.: 16/575,632

(22) Filed: Sep. 19, 2019

(51) Int. Cl.
*E06B 5/11* (2006.01)

(52) U.S. Cl.
CPC ..... *E06B 5/11* (2013.01)

(58) Field of Classification Search
CPC ..... E96B 5/11; E96B 3/26
See application file for complete search history.

(56) References Cited

U.S. PATENT DOCUMENTS 4,059,413 A 11/1977 Forgione
4,249,589 A * 2/1981 Loeb ..... E06B 9/521 160/354
4,562,666 A * 1/1986 Young, III ..... E05B 13/001 49/463
4,590,706 A * 5/1986 Plowman ..... E06B 5/12 49/57
4,867,222 A * 9/1989 Roman ..... E06B 3/285 160/89
5,560,164 A 10/1996 Ahrens
5,737,885 A * 4/1998 Stoyke ..... E06B 3/28 52/202
6,155,009 A * 12/2000 Pena ..... E06B 9/02 52/171.3
6,167,656 B1 1/2001 Devlin
6,393,777 B1 5/2002 Renfrow
6,502,355 B1 * 1/2003 Bori ..... E06B 5/12 248/110
6,918,426 B1 * 7/2005 Westby ..... E06B 9/24 160/368.1
7,818,927 B1 * 10/2010 John ..... E06B 3/74 52/204.1
7,946,333 B1 * 5/2011 Zapata ..... E06B 9/521 160/354
8,490,345 B2 * 7/2013 Fields ..... E05B 65/462 49/371
8,490,346 B2 * 7/2013 Wedren ..... E06B 9/00 49/463
8,550,140 B2 * 10/2013 Kelley ..... E06B 3/28 160/90
9,217,276 B1 * 12/2015 Ory, Jr. ..... E06B 3/28
9,234,381 B2 * 1/2016 Wexler ..... E06B 3/28
9,845,636 B2 * 12/2017 Wexler ..... E06B 3/30
10,196,850 B2 * 2/2019 Wexler ..... E06B 9/24
10,533,364 B2 * 1/2020 Wexler ..... E06B 9/00
2007/0199259 A1 * 8/2007 Parsley ..... E06B 3/28 52/203
2008/0127581 A1 6/2008 Walters
(Continued)

*Primary Examiner* — Beth A Stephan

(57) ABSTRACT

A window security assembly includes a plurality of first brackets that is each mountable on a window in a wall of a building. A plurality of second brackets is each mountable on the window in the wall of the building. A plurality of fasteners is each extended through a respective one of the apertures in a respective one of the first brackets and the second brackets. In this way the first brackets and the second brackets are coupled to the window. A panel is positionable in the first brackets and the second brackets when the first brackets and the second brackets are positioned on the window. The panel is comprised of an impact resistant material to inhibit an intruder from gaining access through the window.

7 Claims, 4 Drawing Sheets

(56) References Cited

U.S. PATENT DOCUMENTS

| | | | | |
|---|---|---|---|---|
| 2013/0111832 | A1* | 5/2013 | Glass | E06B 9/01 52/202 |
| 2013/0239497 | A1* | 9/2013 | Burleson | E06B 9/02 52/203 |
| 2016/0145934 | A1* | 5/2016 | Trott | E06B 5/11 52/203 |

* cited by examiner

WINDOW SECURITY ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to security devices and more particularly pertains to a new security device for inhibiting forced entry through a window in a building.

BRIEF SUMMARY OF THE INVENTION

An embodiment of the disclosure meets the needs presented above by generally comprising a plurality of first brackets that is each mountable on a window in a wall of a building. A plurality of second brackets is each mountable on the window in the wall of the building. A plurality of fasteners is each extended through a respective one of the apertures in a respective one of the first brackets and the second brackets. In this way the first brackets and the second brackets are coupled to the window. A panel is positionable in the first brackets and the second brackets when the first brackets and the second brackets are positioned on the window. The panel is comprised of an impact resistant material to inhibit an intruder from gaining access through the window.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
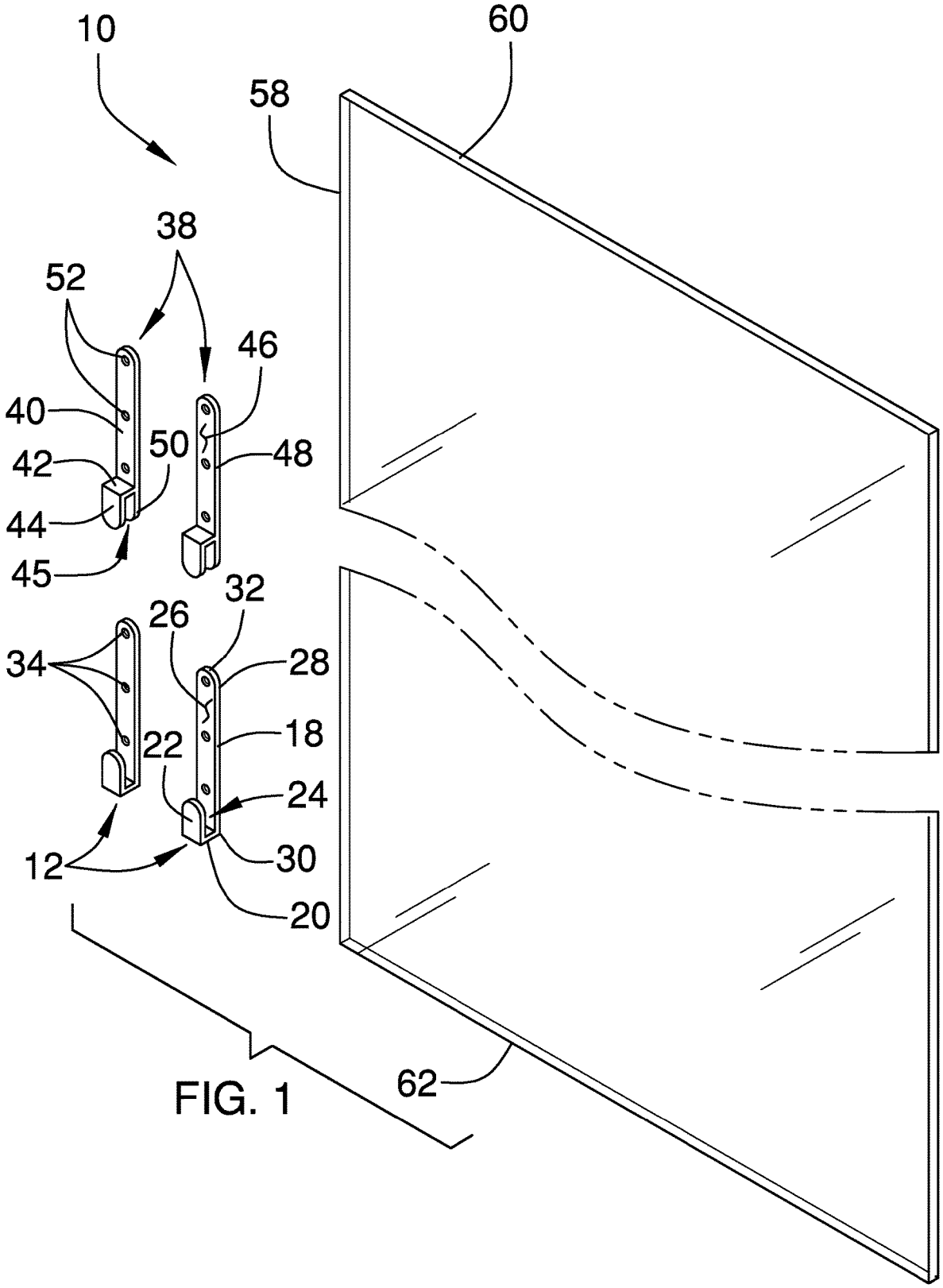
FIG. 1 is a front in-use view of a window security assembly according to an embodiment of the disclosure.
Figure 2:
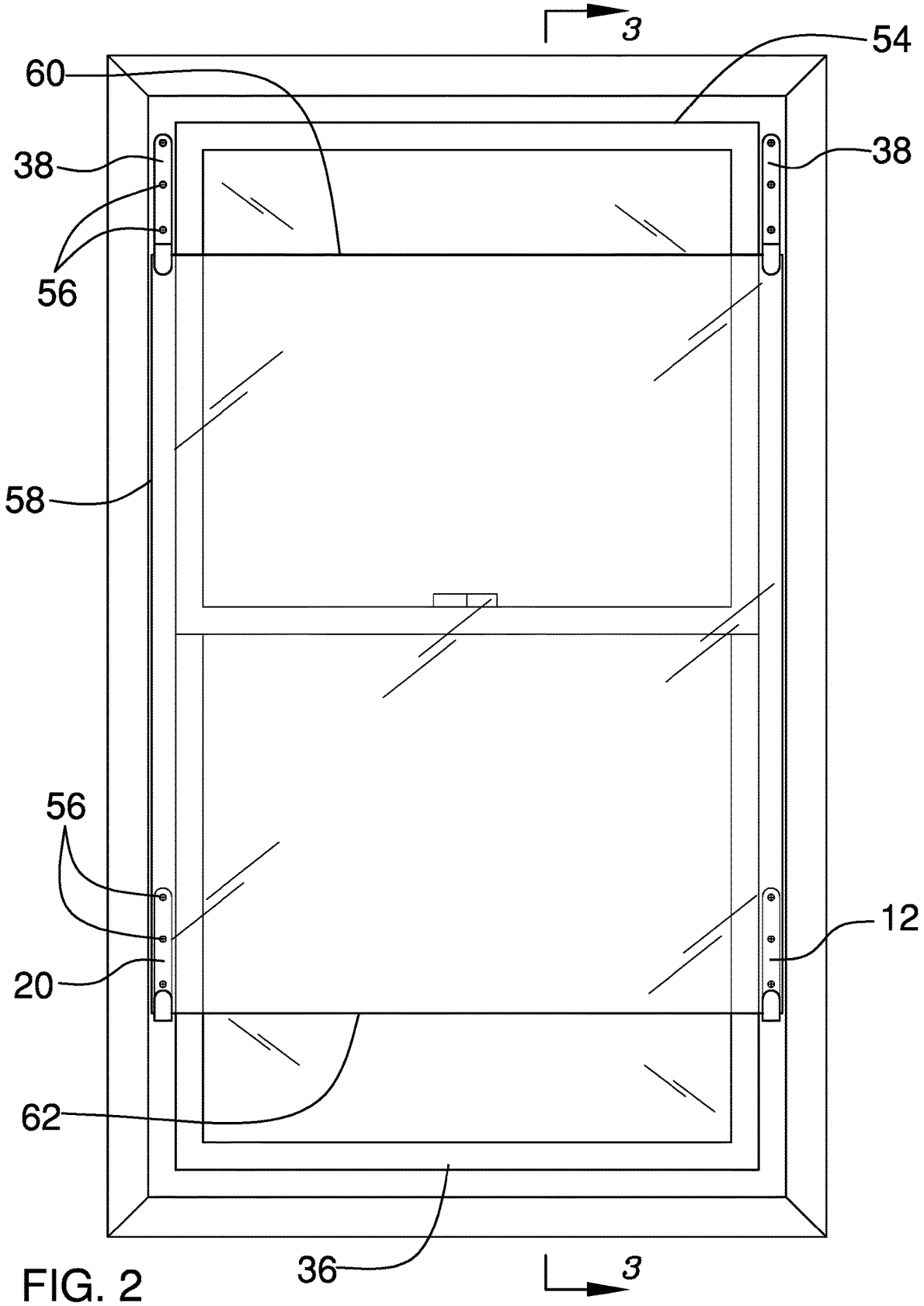
FIG. 2 is a perspective in-use view of an embodiment of the disclosure.
Figure 3:
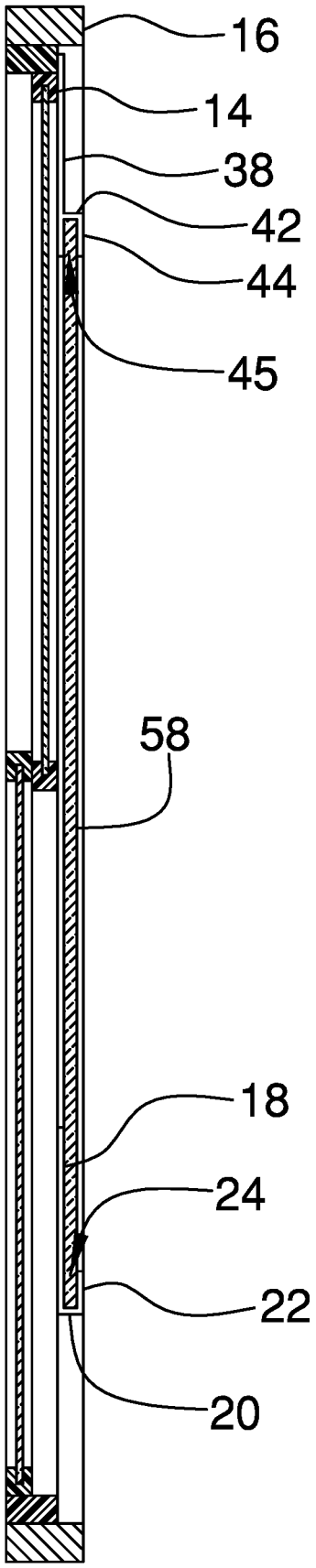
FIG. 3 is a cross sectional view taken along line 3-3 of FIG. 2 of an embodiment of the disclosure.
Figure 4:
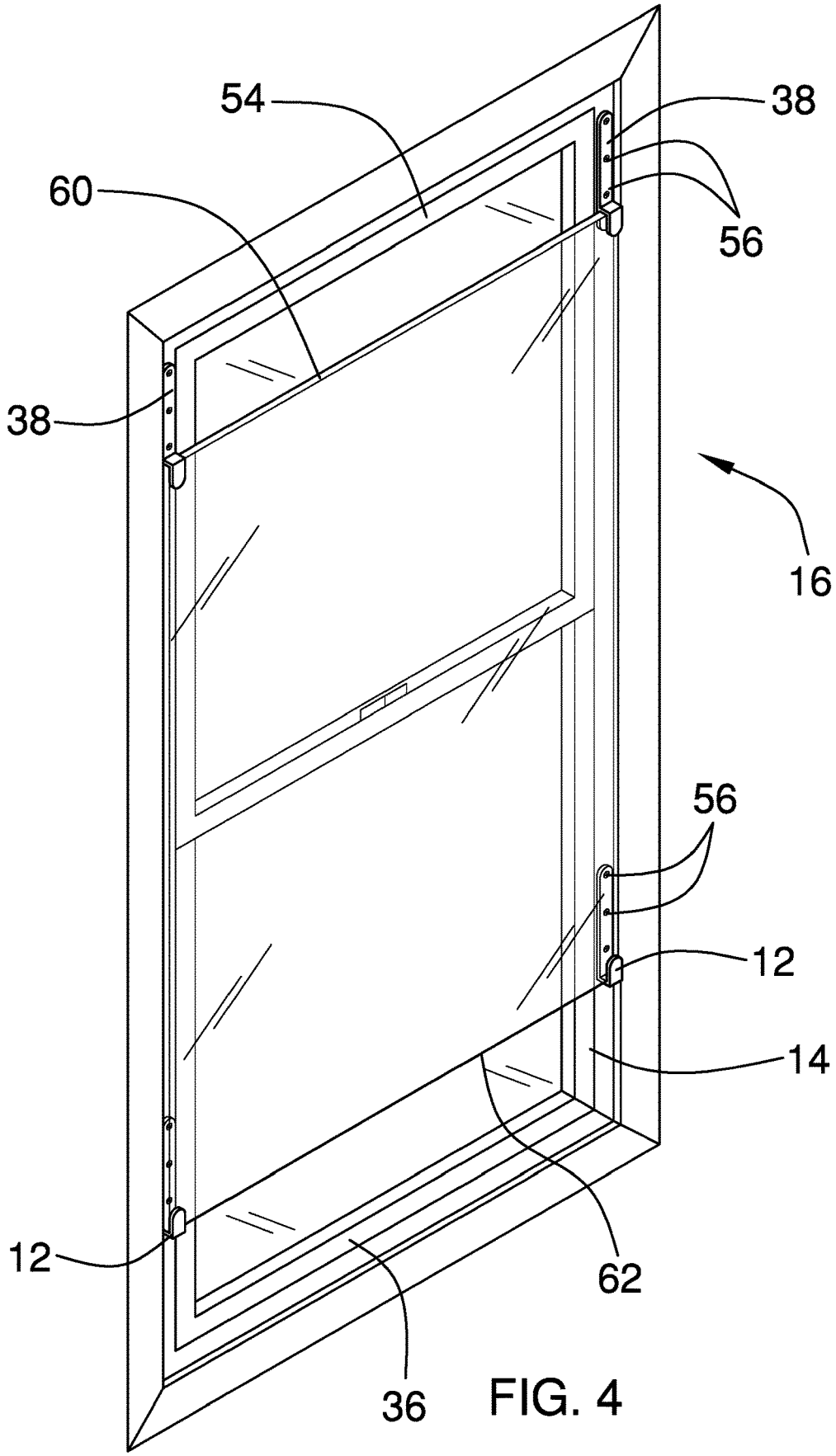
FIG. 4 is a perspective in-use view of an embodiment of the disclosure.

With reference now to the drawings, and in particular to FIGS. 1 through 4 thereof, a new security device embodying the principles and concepts of an embodiment of the disclosure and generally designated by the reference numeral 10 will be described.

As best illustrated in FIGS. 1 through 4, the window security assembly 10 generally comprises a plurality of first brackets 12 that is each mountable on a window 14 in a wall 16 of a building. The first brackets 12 are positioned inside the building. Each of the first brackets 12 includes a mounting portion 18, a leg 20 and a foot 22. The leg 20 extends away from the mounting portion 18 having the foot 22 being oriented parallel with the mounting portion 18. The foot 22 is spaced from the mounting portion 18 to define a space 24 between the foot 22 and the mounting portion 18.

The foot 22 has a length that is less than a length of the mounting portion 18. The mounting portion 18 has a first surface 26, a second surface 28, a first end 30 and a second end 32. The leg 20 is aligned with the first end 30 having the foot 22 being directed toward the second end 32. The mounting portion 18 has a plurality of apertures 34 each extending through the first surface 26 and the second surface 28. The apertures 34 are spaced apart from each other and are distributed along the mounting portion 18. Additionally, each of the first brackets 12 is positioned along a lower threshold 36 of the window 14 having the foot 22 on each of the first brackets 12 being directed upwardly.

A plurality of second brackets 38 is provided and each of the second brackets 38 is mountable on the window 14 in the wall 16 of the building having the second brackets 38 being positioned inside the building. Each of the second brackets 38 has a mounting portion 40, a leg 42 and a foot 44. The leg 42 of each of the second brackets 38 extends away from the mounting portion 40 of the second brackets 38. Additionally, the foot 44 of each of the second brackets 38 is spaced from the mounting portion 40 of the second brackets 38 to define a space 45 in the second brackets 38.

Each of the second brackets 38 has a primary surface 46, a secondary surface 48 and a primary end 50. The leg 42 on the second brackets 38 is spaced from the primary end 50 having the foot 44 on the second brackets 38 being directed toward the primary end 50. The mounting portion 40 of each of the second brackets 38 has a plurality of apertures 52 each extending through the primary surface 46 and the secondary surface 48. Each of the second brackets 38 is positioned along the upper threshold 54 of the window 14 having the foot 44 on each of the second brackets 38 being directed toward the lower threshold 36 of the window 14. Additionally, the apertures 52 on the second brackets 38 are exposed when the panel 58 is positioned in the space 45 in the second brackets 38.

A plurality of fasteners 56 is provided and each of the fasteners 56 is extended through a respective one of the apertures 52 in a respective one of the first brackets 12 and the second brackets 38. In this way the first brackets 12 and the second brackets 38 are coupled to the window 14. The fasteners 56 may comprise screws, nails or any other type of fastener.

A panel 58 is provided and the panel 58 is positionable in the first brackets 12 and the second brackets 38 when the first brackets 12 and the second brackets 38 are positioned on the window 14. In this way the panel 58 covers glass of the window 14. The panel 58 is comprised of an impact resistant material to inhibit an intruder from gaining access through the window 14. The panel 58 has a top edge 60 and a bottom edge 62. The bottom edge 62 is positionable in the space 24 in each of the first brackets 12 such that each of the first brackets 12 supports the weight of the panel 58. Moreover, the top edge 60 is positionable in the space 45 in each of the second brackets 38.

In use, each of the first brackets 12 is attached to the window 14. The first brackets 12 are positioned along or near the lower threshold 36 of the window 14. The bottom edge 62 of the panel 58 is positioned in the space 24 in each of the first brackets 12. Each of the second brackets 38 is positioned on the top edge 60 of the panel 58 and each of the second brackets 38 is attached to the window 14. In this way the panel 58 is positioned over glass in the window 14 to inhibit an intruder from gaining forced entry through the window 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A window security assembly being configured to inhibit an intruder from entering through a window, said assembly comprising:

a plurality of first brackets, each of said first brackets being mountable on a window in a wall of a building having said first brackets being positioned inside the building;

a plurality of second brackets, each of said second brackets being mountable on the window in the wall of the building having said second brackets being positioned inside the building, each of said second bracket having a mounting portion, a leg and a foot, said leg of each of said second brackets extending away from said mounting portion of said second brackets, said foot of each of said second brackets being spaced from said mounting portion of said second brackets to define a space in said second brackets, each of said second brackets having a primary surface, a secondary surface and a primary end, said leg on said second brackets being positioned between said primary end and a secondary end nearer to said primary end than said secondary end, said foot on said second brackets being directed toward said primary end;

a plurality of fasteners, each of said fasteners being extended through a respective aperture of a plurality of apertures in a respective one of said first brackets and said second brackets for coupling said first brackets and said second brackets to the window; and a panel being positionable in said first brackets and said second brackets when said first brackets and said second brackets are positioned on the window wherein said panel is configured to cover glass of the window, said panel being comprised of an impact resistant material wherein said panel is configured to inhibit an intruder from gaining access through the window.

2. The assembly according to claim 1, wherein each of said first brackets includes a mounting portion, a leg and a foot, said leg extending away from said mounting portion having said foot being oriented parallel with said mounting portion, said foot being spaced from said mounting portion to define a space between said foot and said mounting portion, said foot having a length being less than a length of said mounting portion.

3. The assembly according to claim 2, wherein said mounting portion has a first surface and a second surface, a first end and a second end, said leg being aligned with said first end having said foot being directed toward said second end.

4. The assembly according to claim 3, wherein said apertures in said first brackets and said second brackets extend through said first surface and said second surface, said apertures being spaced apart from each other and being distributed along said mounting portion, each of said first brackets being positioned along a lower threshold of the window having said foot on each of said first brackets being directed upwardly.

5. The assembly according to claim 4, wherein said panel has a bottom edge, said bottom edge being positionable in said space in each of said first brackets such that each of said first brackets supports the weight of said panel.

6. The assembly according to claim 1, wherein said mounting portion of each of said second brackets has a plurality of apertures each extending through said primary surface and said secondary surface, each of said second brackets being positioned along the upper threshold of the window having said foot on each of said second brackets being directed toward a lower threshold of the window.

7. The assembly according to claim 6, wherein said panel has a top edge being positionable in said space in each of said second brackets.

* * * * *